US009386809B2

(12) United States Patent
Nilsen et al.

(10) Patent No.: US 9,386,809 B2
(45) Date of Patent: Jul. 12, 2016

(54) QUICK RELEASE VEST SYSTEM

(75) Inventors: Martin J. Nilsen, Hampshire, IL (US); Fred Fulcher, Montebello, CA (US); Martin Garcia, Vernon, CA (US)

(73) Assignee: Illinois Tool Works Inc., Glenview, IL (US)

( * ) Notice: Subject to any disclaimer, the term of this patent is extended or adjusted under 35 U.S.C. 154(b) by 456 days.

(21) Appl. No.: 13/876,238

(22) PCT Filed: Oct. 25, 2011

(86) PCT No.: PCT/US2011/057632

§ 371 (c)(1), (2), (4) Date: Mar. 27, 2013

(87) PCT Pub. No.: WO2012/058199

PCT Pub. Date: May 3, 2012

(65) Prior Publication Data

US 2013/0185851 A1 Jul. 25, 2013

Related U.S. Application Data

(60) Provisional application No. 61/406,652, filed on Oct. 26, 2010.

(51) Int. Cl.

| | |
|---|---|
| ***A41D 1/04*** | (2006.01) |
| ***F41H 1/02*** | (2006.01) |
| ***A41D 13/05*** | (2006.01) |

(52) U.S. Cl.

CPC ..... *A41D 1/04* (2013.01); *A41D 13/0518* (2013.01); *F41H 1/02* (2013.01); *Y10T 24/4079* (2015.01); *Y10T 24/4736* (2015.01); *Y10T 24/4764* (2015.01)

(58) Field of Classification Search

CPC .. A41D 1/04; Y10T 24/4079; Y10T 24/4089; Y10T 24/4736; Y10T 24/4764; F41H 1/02

USPC ..... 2/2.5, 102, 463; 89/36.05

See application file for complete search history.

(56) References Cited

U.S. PATENT DOCUMENTS

| | | | | |
|---|---|---|---|---|
| 3,452,362 | A * | 7/1969 | Korolick | F41H 1/02 2/2.5 |
| 5,890,227 | A * | 4/1999 | Brown | A41D 13/0007 2/102 |
| 6,948,188 | B2 | 9/2005 | D'Annunzio | |
| 7,814,567 | B2 * | 10/2010 | Dovner | F41H 1/02 2/2.5 |

(Continued)

FOREIGN PATENT DOCUMENTS

| | | | |
|---|---|---|---|
| JP | 2010159532 | A | 7/2010 |
| WO | 2009047790 | A2 | 4/2009 |
| WO | 2009126190 | A2 | 10/2009 |

OTHER PUBLICATIONS

International Search Report issued in PCT/US2011/057632 on Feb. 15, 2012.

*Primary Examiner* — Katherine Moran

(57) ABSTRACT

A vest incorporating a pull element operatively connected to a plurality of tether lines extending along pathways to panel connection points at which front and rear panels of the vest are adjoined. When the pull element is extended away from the vest, the tether lines are placed into tension thereby causing the connection assemblies to be disengaged and the front and rear panels of the vest can fall away from one another.

20 Claims, 5 Drawing Sheets

(56) References Cited

U.S. PATENT DOCUMENTS 8,813,263 B2 * 8/2014 Parisi, Jr. ..... F41H 1/02 2/102
9,003,947 B1 * 4/2015 Rittenhouse, Jr. ..... F41H 1/02 2/2.5
2010/0043112 A1 2/2010 Khandelwal
2010/0313327 A1 * 12/2010 Anscher ..... F41H 1/02 2/102
2011/0023207 A1 2/2011 Storms, Jr. et al.

* cited by examiner

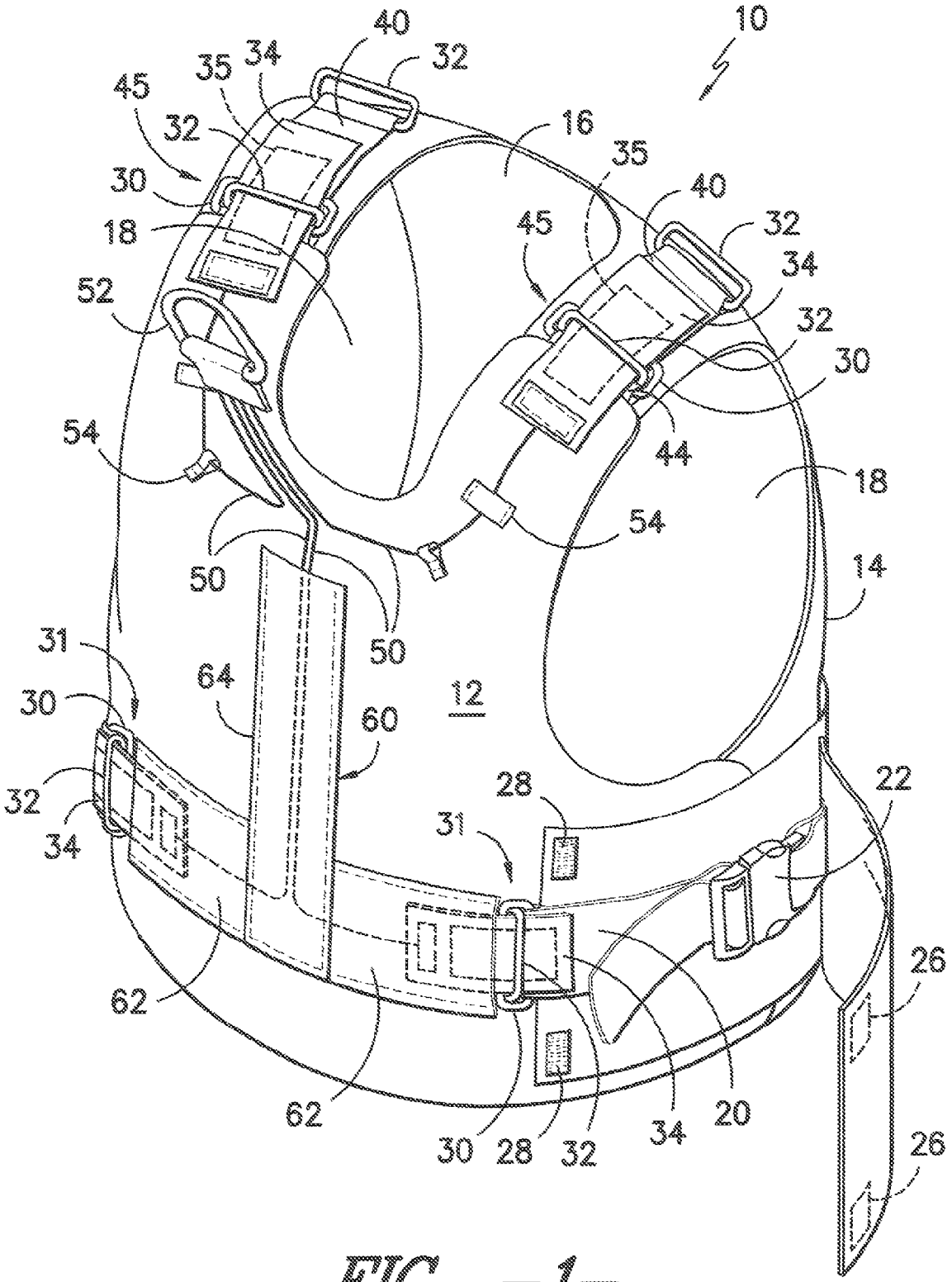
FIG. —1—

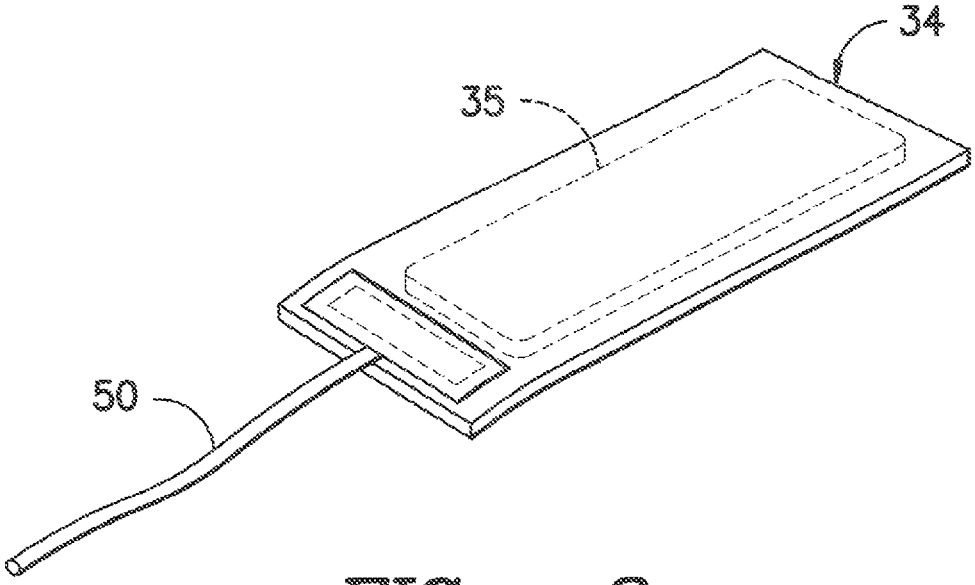
FIG. —2—
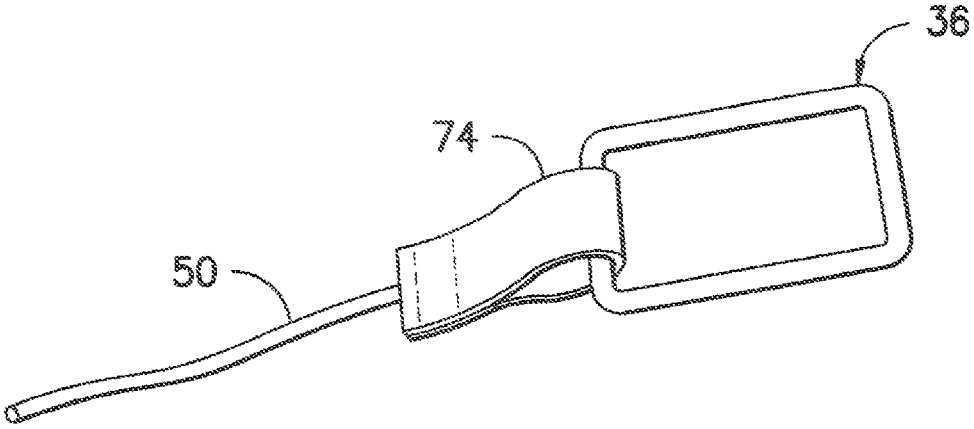
FIG. —3—

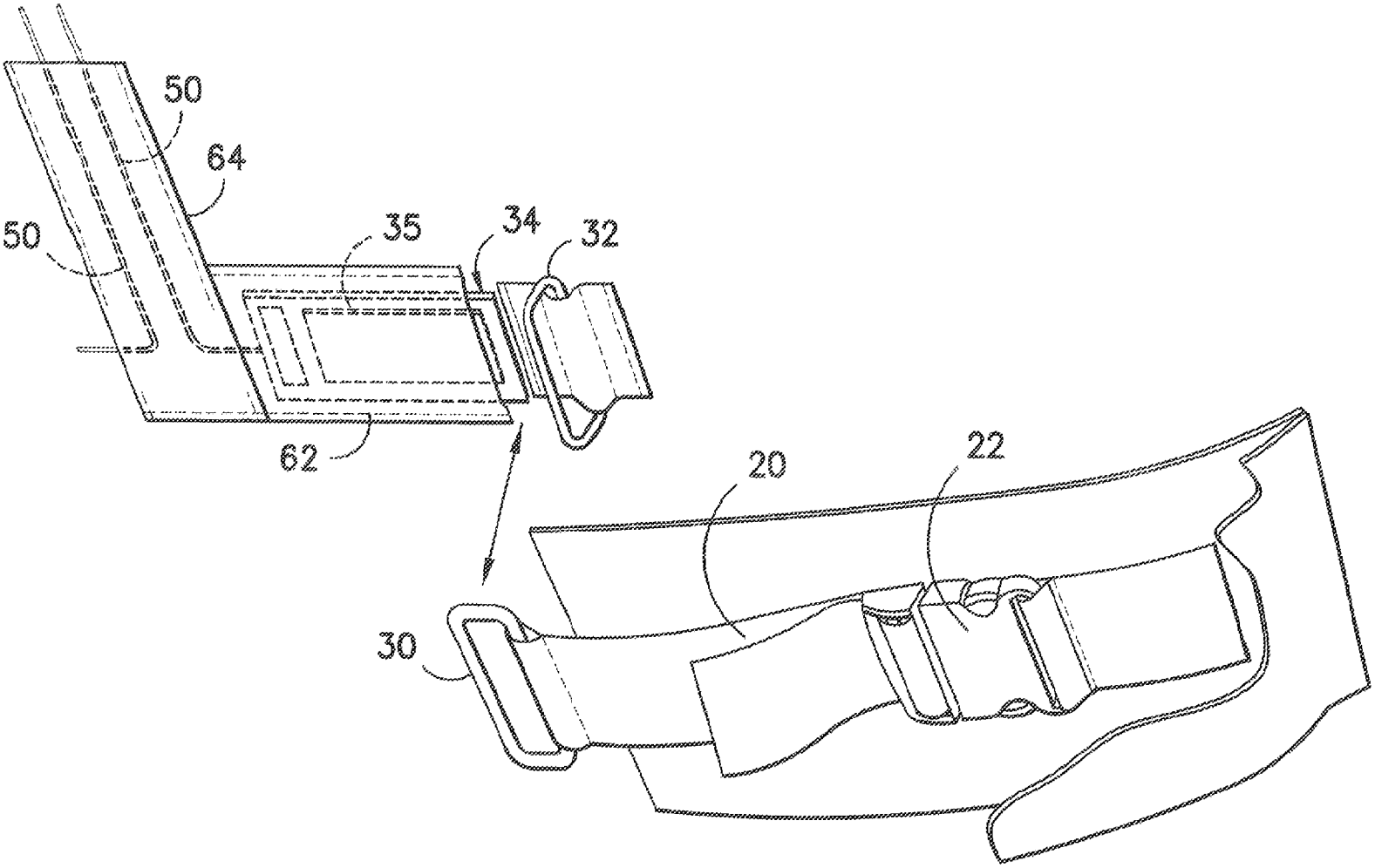
FIG. —4—

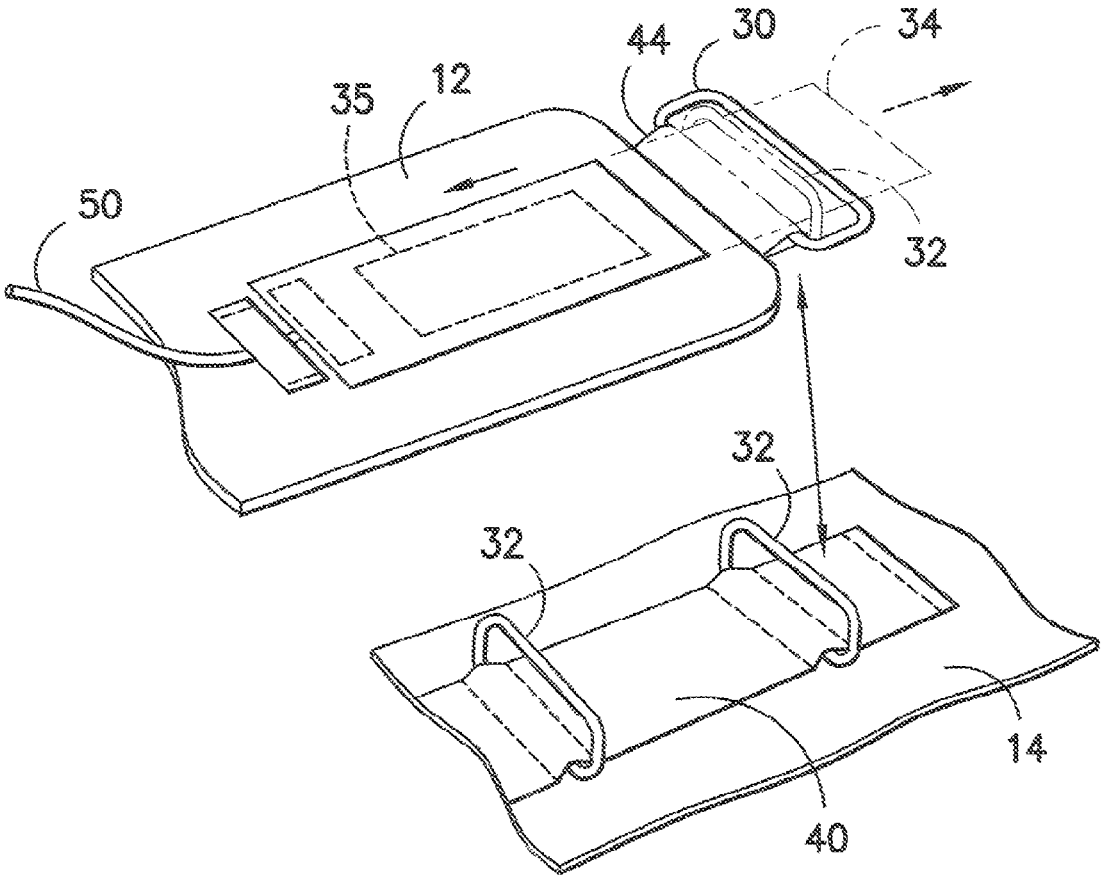
FIG. —5—

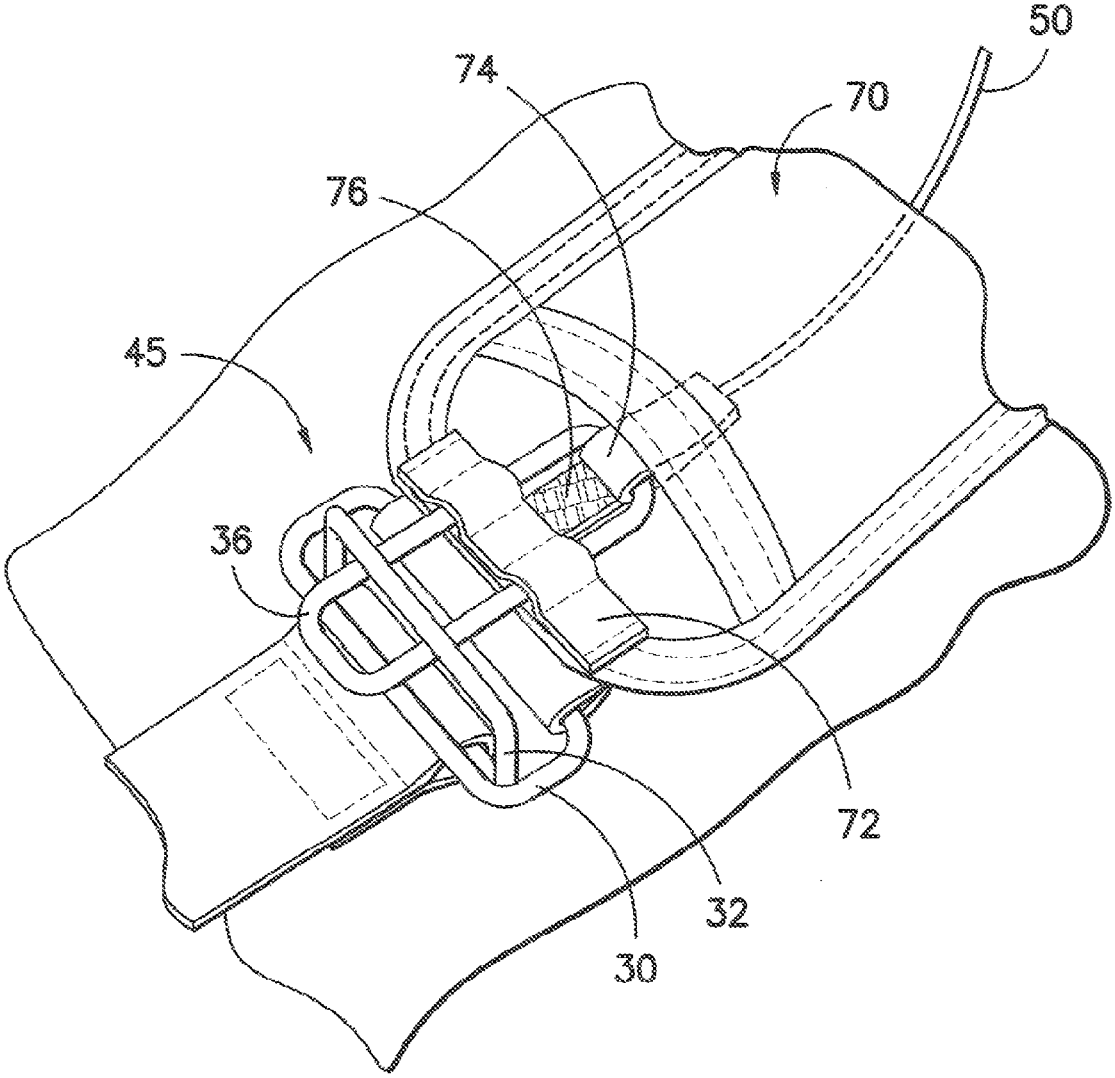
FIG. —6—

QUICK RELEASE VEST SYSTEM

RELATED APPLICATIONS

The present application is a National Phase of PCT/US2011/057632, filed Oct. 25, 2011, and is based on, and claims priority from, U.S. Provisional Patent Application No. 61/406,652, filed Oct. 26, 2010.

TECHNICAL FIELD

The present invention relates generally to a torso covering, and more particularly to a vest adapted to provide torso coverage during use but which can be rapidly disengaged for removal by manipulating a single pull element operatively connected to break-away connections adjoining panels of the vest. Upon manual manipulation of the pull element, the panels of the vest disengage from one another and fall away from a user's body without the need for additional movement of the user.

BACKGROUND OF THE INVENTION

It is known to use vests for torso coverage. Vests have the benefit of providing coverage over a user's torso while leaving the arms free from obstruction. By way of example only, and not limitation, vests formed from aramid and para-aramid materials are often used to provide protection to users such as police officers, military personnel or the like. Such vests serve a primary function of protecting against damage to core body organs as a result of projectile impact.

It is generally desirable for vests to be put on and removed easily. In the past, it has been typical to use so called "quick release" clips at front or side openings. One prior clip arrangement incorporates a male member with a pair of laterally disposed legs that snap in locking relation within a relatively flat female body. In such a construction, portions of the snap legs typically project through openings in the lateral sides of the female body in locking relation. The locking relation is disengaged by a user pressing inwardly against the lateral sides of the body to force the snap legs to the interior while applying a separating tensioning force. This permits the legs of the male member to be pulled outwardly from the body. While such prior structures provide excellent connective properties, each clip must be manipulated independently to remove the vest. Moreover, once the clips are disengaged, it is still necessary to manipulate a user's arms as the vest is pulled off.

As will be appreciated, if the wearer of the vest suffers a serious injury, it may be desirable to minimize movement as treatment is administered. Moreover, it may be necessary to remove the vest in order to gain access to the injury site. In those situations it may be necessary to cut traditional vests away from the user to provide rapid treatment. However, due to the nature of the materials forming the vest which are resistant to cutting and puncture, removal by cutting may be difficult and may consume valuable treatment time.

In light of the above, a continuing need exists for a vest system which provides torso coverage during normal use, but which also can be readily removed from a user without the need to manipulate individual clip elements and without the need to subject the user to substantial movement.

SUMMARY OF THE INVENTION

The present invention provides advantages and alternatives over the prior art by providing a vest incorporating a pull element operatively connected to a plurality of tether lines extending along channel pathways to panel connection points at which front and rear panels of the vest are adjoined. When the pull element is extended away from the vest, the tether lines are placed into tension thereby causing the connection assemblies to be disengaged and the front and rear panels of the vest can fall away from one another.

In accordance with one exemplary aspect, the present invention provides a protective vest adapted for rapid removal from a wearer. The vest includes a front panel adapted to cover at least a portion of the wearer's chest and a rear panel adapted to cover at least a portion of the wearer's back. A first waist connection assembly and at least a second waist connection assembly operatively join the front panel to the rear panel substantially at the wearer's waist. The waist connection assemblies each include a retractable locking element adapted to move between a locked and unlocked condition. A first shoulder connection assembly and at least a second shoulder connection assembly operatively join the front panel to the rear panel substantially at the shoulders of the wearer. The shoulder connection assemblies each include a retractable locking element adapted to move between a locked and unlocked condition. A plurality of tether lines are operatively connected to a common pull element with at least one tether line operatively connecting each of the retractable locking elements to the common pull element. Upon extension of the common pull element, the tether lines displace the retractable locking elements and disengage each of the waist connection assemblies and shoulder connection assemblies.

In accordance with another exemplary aspect, the present invention provides a method of rapidly removing a protective vest from a wearer. The method includes the steps of providing a front panel adapted to cover at least a portion of the wearer's chest and a rear panel adapted to cover at least a portion of the wearer's back. A first waist connection assembly and at least a second waist connection assembly are provided operatively joining the front panel to the rear panel substantially at the wearer's waist. The waist connection assemblies each include a rotatable hasp ring structure projecting through a rotatable base ring with a retractable male member adapted to move between a locked condition projecting through the hasp ring structure and an unlocked condition withdrawn from the hasp ring structure. A first shoulder connection assembly is provided operatively joining the front panel to the rear panel substantially at a first shoulder of the wearer and at least a second shoulder connection assembly is provided operatively joining the front panel to the rear panel substantially at second shoulder of the wearer. The shoulder connection assemblies each include a rotatable hasp ring structure projecting through a rotatable base ring with a retractable male member adapted to move between a locked condition projecting through the hasp ring structure and an unlocked condition withdrawn from the hasp ring structure. A plurality of tether lines are provided operatively connected to a common pull element with at least one tether line operatively connecting each of the retractable male members to the common pull element. The common pull element is extended such that the tether lines displace the retractable male members and disengage each of the waist connection assemblies and shoulder connection assemblies substantially simultaneously.

BRIEF DESCRIPTION OF THE DRAWINGS

FIG. 1 is a schematic view illustrating a formed vest with front and rear panels attached by releasable connection assemblies operatively connected to tether lines extending from a common activating pull;

FIG. 2 is a schematic view illustrating one exemplary construction for male members adapted to project through hasp rings and to be operatively connected via tether lines to an activating pull element to effect removal from the hasp rings;

FIG. 3 is a schematic view illustrating another exemplary construction for male members adapted to project through hasp rings and to be operatively connected via tether lines to an activating pull element to effect removal from the hasp rings;

FIG. 4 is a schematic view illustrating an exemplary connection system for use in joining vest panels together at the waist;

FIG. 5 is a schematic view illustrating an exemplary connection system for use in joining vest panels together at the shoulders and incorporating multiple hasp rings in series to facilitate adjustment; and FIG. 6 is a schematic view illustrating an exemplary releasable buckle assembly in an operative connected state with an outwardly biased retractable male member inserted through a hasp ring.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed and equivalents thereof as well as additional items and equivalents thereof.

DETAILED DESCRIPTION OF THE PREFERRED EMBODIMENTS

Reference will now be made to the drawings, wherein to the extent possible, like elements are designated by like reference numerals in the various views. Referring to FIG. 1, a vest 10 is illustrated. By way of example only, and not limitation, the vest 10 may be a protective garment formed from materials such as woven aramid or para-aramid fibers adapted to resist penetration.

In the illustrated exemplary construction, the vest 10 is formed from a front panel 12 and a rear panel 14 which are oriented in opposing relation to one another to define a neck opening 16 and a pair of arm openings 18. As shown, the rear panel 14 may include one or more waist straps 20 threaded through an adjustable buckle 22. By way of example only, a waist strap 20 may be located on either side of the vest 10. Of course, the adjustable buckle 22 may be eliminated if desired such that the strap 20 is of substantially fixed length. A cover panel (only one shown) may be disposed in flap-like relation on either side of the vest 10 to cover the waist straps 20 and the adjustable buckle 22 during use. By way of example only, the free end of the cover panel may include one or more connection structures 26 such as one half of a hook and loop fabric for releasable attachment to complementary structures 28 such as the complementary half of a hook and loop fabric. Of course, other joining techniques may likewise be used if desired.

As best seen through joint reference to FIGS. 1 and 4, in the exemplary construction a free end of the waist strap 20 includes a large diameter base ring 30 which operates as part of a releasable waist connection assembly 31 joining the front panel 12 to the rear panel 14. The base ring 30 is preferably substantially rotatable relative to the waist strap 20 so as to be rotatable between a substantially flattened condition and a raised condition transverse to the waist strap 20. Rotation through about a 90 degree arc or more may be desirable. Rotation through about a 180 degree arc or more may be particularly desirable.

In the illustrated exemplary construction, a hasp ring 32 may be held in generally rotatable relation to a fixed point on the front panel 12 at a position generally aligned with a corresponding waist strap 20 on the opposing rear panel 14. By way of example only, the hasp ring may be held within a loop sewn to the front panel 12. However, other arrangements may likewise be used if desired. The hasp ring 32 is preferably substantially rotatable through a wide arc so as to be rotatable between a generally flattened condition and a raised condition transverse to the underlying panel. Rotation through about a 90 degree arc or more may be desirable. Rotation through a full 180 degree arc or more may be particularly desirable in some environments of use.

In the illustrated exemplary construction, the hasp ring 32 has an effective outer diameter which is less than the inner diameter of the base ring 30. Thus, at least a portion of the hasp ring 32 may be inserted through the base ring 30 to form a waist connection between the front panel 12 and the rear panel 14. The base ring 30 and the hasp ring 32 each preferably has a relatively smooth outer surface and may be formed from similar or dissimilar materials. Exemplary materials of construction may include metal, rigid plastic, or the like. As will be appreciated, in the illustrated exemplary construction in which the base ring 30 is operatively connected to the adjustable length waist strap 20, the relative positions of the base ring 30 and the hasp ring 32 may be adjusted as desired to accommodate different waist sizes. Of course, it is contemplated the position of the hasp ring also may be adjustable if desired. By way of example only, such adjustment may be through use of an adjustable length strap (not shown) or other suitable technique.

As will be appreciated, with the hasp ring 32 inserted into the base ring 30, the resulting connection is not secure and will tend to fall apart. As best seen through joint reference to FIGS. 1, 2, 3 and 4, in the exemplary construction a retractable locking element in the form of a displaceable male member such as a sewn pocket 34 of fabric or the like with a strengthening insert 35 held at the interior (FIGS. 2 and 4) is positioned at the front panel 12 for insertion into the portion of the hasp ring 32 projecting through the base ring 30. In another exemplary construction, the displaceable male member may be a ring structure 36 (FIG. 3) of metal or the like. The ring structure 36 may preferably have a generally elongated configuration with either a flat or curved distal end adapted for insertion into the hasp ring 32. As will be appreciated, with the male member in the inserted condition (FIG. 1), the hasp ring 32 is blocked against being withdrawn from the base ring 30. However, both the hasp ring 32 and the base ring 30 can nonetheless rotate to assume a low profile, flattened condition.

As best seen through joint reference to FIGS. 1 and 5, the front panel 12 and the rear panel 14 may be connected at the shoulders of the vest in a substantially similar manner using shoulder straps 40 on the rear panel 14 having multiple hasp rings 32 arranged in series. Thus, adjustments to the shoulders can be made by selecting which hasp ring is used. The hasp rings 32 at the shoulder are preferably substantially rotatable through a wide arc so as to be rotatable between a generally flattened condition and a raised condition transverse to the underlying panel. Rotation through about a 90 degree arc or more may be desirable. Rotation through a full 180 degree arc or more may be particularly desirable in some environments of use. Of course, it is also contemplated that adjustable buckles may be used at the shoulders and/or that multiple hasp rings arranged in series (FIG. 4) may be used at the waist if desired.

As best illustrated in FIG. 5, in the exemplary construction a base ring 30 is operatively connected to the front panel 12 at each of the shoulders. In the illustrated arrangement the base ring 30 at each shoulder is held in rotatable relation within a sewn loop 44 of fabric or the like projecting outwardly from an edge of the shoulder portion of the front panel 12. However, other suitable connection techniques may likewise be used if desired. The base ring 30 at the shoulder is preferably substantially rotatable relative to the front panel connection point. Rotation through about a 90 degree arc or more may be desirable. Rotation through about a 180 degree arc or more may be particularly desirable in some environments of use.

As will be appreciated, a user may select the hasp ring 32 of choice on the shoulder strap 40 for mateable insertion into the corresponding base ring 30 to establish a releasable shoulder connection assembly 45 of adjustable character as desired. In this regard, while the shoulder straps 40 are illustrated as supporting two hasp rings 32, a larger or smaller number of hasp rings may be provided for adjustability. The unused hasp rings 32 at the shoulder may rotate to a substantially flattened condition, thereby avoiding interference during use.

As with the waist connection assembly 31, the shoulder connection assembly 45 is not secure and will tend to fall apart. In the exemplary construction a displaceable male member such as the sewn pocket 34 or ring structure 36 as previously described is positioned at the front panel 12 for insertion into the portion of the hasp ring 32 projecting through the base ring 30. With the male member in the inserted condition (FIG. 1), the hasp ring 32 is blocked against being withdrawn from the base ring 30. However, both the hasp ring 32 and the base ring 30 can nonetheless rotate to assume a low profile, flattened condition.

In the exemplary construction illustrated in FIG. 1, the male members at the shoulder connection assemblies 45 are in the form of a sewn pocket 34 as previously described. However, other constructions may be used. In the event that the sewn pocket 34 is used, such a structure may be sized to fit in a relatively tight wedged relation at the interior of the corresponding hasp ring 32 such that it is held in place. The covering material surrounding the strengthening insert 35 may have a textured surface to increase friction if desired. Of course, similar constructions also may be used at the waist if desired. As will be appreciated, each of the waist connection assemblies 31 and each of the shoulder connection assemblies 45 may be attached and detached individually by a user during regular use. Accordingly, during regular use, a wearer may manually release and reengage any of the connection assemblies as the vest 10 is being put on or taken off. The ability to quickly attach and detach the connection points facilitates both speed and ease of use. Likewise, the ability to release and reengage any of the connection assemblies individually permits a wearer to adjust the fit of the vest 10 without complete removal of the entire structure.

Regardless of the configuration of the male members adapted for insertion into the hasp rings 32, in the exemplary construction such male members are each operatively connected to an elongated tether line 50. As best seen in FIG. 1, the elongated tether lines 50 extend along defined travel paths between the male members and a common pull element 52 such as a ring structure or the like. In operation, the pull element 52 may be grasped and pulled away from the vest 10, thereby extending the tether lines and retracting the male members out of the corresponding hasp rings 32. With male members retracted from the hasp rings 32, both the waist connection assemblies 31 and the shoulder connection assemblies 45 will fall apart thereby releasing the connection between the front panel 12 and the rear panel 14 and causing the vest 10 to fall away from the user. As will be appreciated, all elements of the system including the tether lines 50, base rings 30, hasp rings 32, and male members are operatively secured to either the front panel 12 or to the rear panel 14. Accordingly, when the common pull element 52 is extended, causing the front panel 12 and the rear panel 14 to fall away from the user, the individual components will remain attached to one or the other of the panels. Thus, components are not lost, and the vest 10 can be easily reassembled for subsequent use.

In practice, the tether lines 50 may run through tubing or sewn channels or may be threaded through spaced guide elements 54 positioned along a defined travel path to facilitate controlled travel. By way of example only, and not limitation, the tether lines 50 extending between the pull element 52 and the waist connection assemblies may be disposed within sewn channels at the interior of a surface patch structure 60 which may have a generally inverted "T" shaped configuration. The surface patch structure may be formed from a fabric or other suitable material and may be stitched along its perimeter to form a pocket-like covering for the tether lines 50.

As illustrated, the surface patch structure may include a pair of opposing lateral legs 62 projecting away from an elongated central vertical segment 64. The lateral legs 62 may be stitched to the front panel 12 to each define a pocket cover for a tether line 50 operatively connected to a retractable male member such as the sewn pocket 34 or ring structure 36 as described previously.

By way of example only, one exemplary construction for a waist connection assembly 31 and/or a shoulder connection assembly 45 is illustrated in FIG. 6. In this arrangement, a male member in the form of the sewn pocket 34 or ring structure 36 as described previously is supported in retractable relation within a pocket housing 70 having an open end projecting towards the connection point. In practice, such a pocket housing 70 may be secured to the front panel 12 at the shoulder or the waist by sewing or other suitable techniques such that the male member projects away from the edge towards an opposing portion of the rear panel 14. In the illustrated exemplary arrangement, the base ring 30 is secured in rotatable relation to the pocket housing 70 by use of a sewn loop or other suitable structure. The male member in the form of an elongated ring structure 36 is disposed between a portion of the pocket housing and a travel guide 72 of fabric or other suitable material which is stitched or otherwise secured in place. As shown, the travel guide 72 is of double yoke construction stitched in place to define a pair of guide channels for slidingly supporting the opposing legs of the ring structure 36. This arrangement facilitates controlled sliding reciprocation of the ring structure 36 during operation.

As may be seen through joint reference to FIGS. 3 and 6, in the exemplary construction of FIG. 6, the ring structure 36 may be operatively connected to the corresponding tether line 50 using an intermediate connection loop 74. Moreover, a biasing element 76 such as a piece of elastic or other stretchable material may be secured between the connection loop 74 (or some other structure which moves with the ring structure) and the travel guide 72 (or some other static portion of the pocket structure). Thus, when the ring structure 36 is pulled inwardly to the interior of the pocket housing 70, the biasing element 76 will be stretched from its normal condition and the ring structure 36 will be urged continuously back to the extended condition shown in FIG. 6. Of course, a similar biasing arrangement may be used with the male member in the form of a sewn pocket 34 with the biasing element secured between the sewn pocket and a portion of the pocket housing.

Regardless of the actual construction used to support the male member, in an embodiment which uses outward biasing, the male member normally extends in outward projecting relation to extend through an opposing hasp ring and thereby prevent separation of the hasp ring 32 and base ring 30. Upon extension of the pull element 52, the tether line 50 will act to pull the male member away from engagement with the hasp ring 32, thereby permitting separation of the hasp ring 32 and base ring 30. However, upon removal of the tensioning force, the male member will spring back into place due to the recovery force provided by the biasing element 76. Accordingly, a single pull action may be used to fully release the vest in an emergency situation. Following release, the elements return to their normal position for reassembly.

Of course, variations and modifications of the foregoing are within the scope of the present invention. Thus, it is to be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments and equivalents to the extent permitted by the prior art.

What is claimed is:

1. A protective vest adapted for rapid removal from a wearer, the vest comprising:

a front panel adapted to cover at least a portion of the wearer's chest;

a rear panel adapted to cover at least a portion of the wearer's back;

a first waist connection assembly operatively joining the front panel to the rear panel substantially at a position overlying the wearer's waist during use and at least a second waist connection assembly operatively joining the front panel to the rear panel substantially at a position overlying the wearer's waist during use, wherein the waist connection assemblies each include a retractable locking element adapted to move between a locked and unlocked condition;

a first shoulder connection assembly operatively joining the front panel to the rear panel substantially at a position overlying a first shoulder of the wearer during use and at least a second shoulder connection assembly operatively joining the front panel to the rear panel substantially at a position overlying a second shoulder of the wearer during use, wherein the shoulder connection assemblies each include a retractable locking element adapted to move between a locked and unlocked condition; and a plurality of tether lines operatively connected to a common pull element with at least one tether line operatively connecting each of the retractable locking elements to the common pull element, such that upon extension of the common pull element, the tether lines displace the retractable locking elements and disengage each of the waist connection assemblies and shoulder connection assemblies wherein at least one of the waist connection assemblies or shoulder connection assemblies comprises a rotatable base ring having an interior in combination with a rotatable hasp ring structure matedly received at the interior of the base ring, and wherein in the locked condition the retractable locking element projects through the hasp ring structure to block the hasp ring structure against removal from the base ring.

2. The protective vest as recited in claim 1, wherein each of the front panel and the rear panel is formed from an aramid or para-aramid fabric.

3. The protective vest as recited in claim 1, wherein each of the first waist connection assembly and the second waist connection assembly includes a rotatable base ring having an interior in combination with a rotatable hasp ring structure matedly received at the interior of the base ring, and wherein in the locked condition the retractable locking element projects through the hasp ring structure to block the hasp ring structure against removal from the base ring.

4. The protective vest as recited in claim 3, wherein the base ring is operatively connected to the rear panel and the hasp ring is operatively connected to the front panel.

5. The protective vest as recited in claim 4, wherein at least one retractable locking element comprises a sewn pocket structure including a strengthening insert.

6. The protective vest as recited in claim 3, wherein at least one retractable locking element comprises a ring structure mounted in slideable relation at to a pocket housing.

7. The protective vest as recited in claim 6, wherein a base ring is operatively connected to the pocket housing.

8. The protective vest as recited in claim 7, wherein a biasing element extends in operative connection between said at least one retractable locking element and the pocket housing, the biasing element normally urging said at least one retractable locking element to the locked condition.

9. The protective vest as recited in claim 1, wherein each of the first shoulder connection assembly and the second shoulder connection assembly includes a rotatable base ring having an interior in combination with a rotatable hasp ring structure matedly received at the interior of the base ring, and wherein in the locked condition the retractable locking element projects through the hasp ring structure to block the hasp ring structure against removal from the base ring.

10. The protective vest as recited in claim 9, wherein the hasp ring structure is disposed on a shoulder strap operatively connected to the rear panel, the shoulder strap including a plurality of hasp ring structures arranged in series.

11. The protective vest as recited in claim 9, wherein at least one retractable locking element comprises a sewn pocket structure including a strengthening insert.

12. The protective vest as recited in claim 9, wherein at least one retractable locking element comprises a ring structure mounted in slideable relation at to a pocket housing.

13. The protective vest as recited in claim 12, wherein a base ring is operatively connected to the pocket housing.

14. The protective vest as recited in claim 13, wherein a biasing element extends in operative connection between said at least one retractable locking element and the pocket housing, the biasing element normally urging said at least one retractable locking element to the locked condition.

15. A protective vest adapted for rapid removal from a wearer, the vest comprising:

a front panel adapted to cover at least a portion of the wearer's chest;

a rear panel adapted to cover at least a portion of the wearer's back;

a first waist connection assembly operatively joining the front panel to the rear panel substantially at a position overlying the wearer's waist during use and at least a second waist connection assembly operatively joining the front panel to the rear panel substantially at a position overlying the wearer's waist during use, wherein the waist connection assemblies each include a rotatable hasp ring structure projecting through a rotatable base ring with a retractable male member adapted to move between a locked condition projecting through the hasp ring structure and an unlocked condition withdrawn from the hasp ring structure;

a first shoulder connection assembly operatively joining the front panel to the rear panel substantially at a position overlying a first shoulder of the wearer during use and at least a second shoulder connection assembly operatively joining the front panel to the rear panel substantially at a position overlying a second shoulder of the wearer during use, wherein the shoulder connection assemblies each include a rotatable hasp ring structure projecting through a rotatable base ring with a retractable male member adapted to move between a locked condition projecting through the hasp ring structure and an unlocked condition withdrawn from the hasp ring structure; and a plurality of tether lines operatively connected to a common pull element with at least one tether line operatively connecting each of the retractable male members to the common pull element, such that upon extension of the common pull element, the tether lines displace the retractable male members and disengage each of the waist connection assemblies and shoulder connection assemblies substantially simultaneously.

16. The protective vest as recited in claim 15, wherein each of the front panel and the rear panel is formed from an aramid or para-aramid fabric.

17. The protective vest as recited in claim 15, wherein at least one retractable male member comprises a sewn pocket structure including a strengthening insert.

18. The protective vest as recited in claim 15, wherein at least one retractable male member comprises a ring structure mounted in slideable relation to a pocket housing with a base ring operatively connected to the pocket housing.

19. The protective vest as recited in claim 18, wherein a biasing element extends in operative connection between said at least one retractable male member and the pocket housing, the biasing element normally urging the retractable locking element to the locked condition.

20. A method of rapidly removing a protective vest from a wearer, the method comprising:

providing a front panel adapted to cover at least a portion of the wearer's chest;

providing a rear panel adapted to cover at least a portion of the wearer's back;

providing a first waist connection assembly operatively joining the front panel to the rear panel substantially at the wearer's waist and at least a second waist connection assembly operatively joining the front panel to the rear panel substantially at the wearer's waist, wherein the waist connection assemblies each include a rotatable hasp ring structure projecting through a rotatable base ring with a retractable male member adapted to move between a locked condition projecting through the hasp ring structure and an unlocked condition withdrawn from the hasp ring structure;

providing a first shoulder connection assembly operatively joining the front panel to the rear panel substantially at a first shoulder of the wearer and at least a second shoulder connection assembly operatively joining the front panel to the rear panel substantially at second shoulder of the wearer, wherein the shoulder connection assemblies each include a rotatable hasp ring structure projecting through a rotatable base ring with a retractable male member adapted to move between a locked condition projecting through the hasp ring structure and an unlocked condition withdrawn from the hasp ring structure;

providing a plurality of tether lines operatively connected to a common pull element with at least one tether line operatively connecting each of the retractable male members to the common pull element; and extending the common pull element such that the tether lines displace the retractable male members and disengage each of the waist connection assemblies and shoulder connection assemblies substantially simultaneously.

* * * * *